US012753613B2

(12) United States Patent
Boucké

(10) Patent No.: US 12,753,613 B2
(45) **Date of Patent: *Oct. 6, 2026**

(54) PANEL, COVERING, AND METHOD OF UNCOUPLING TWO INTERCONNECTED PANELS

(71) Applicant: i4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 0 days.

This patent is subject to a terminal disclaimer.

(21) Appl. No.: 19/341,115

(22) Filed: Sep. 26, 2025

(65) Prior Publication Data

US 2026/0022569 A1 Jan. 22, 2026

Related U.S. Application Data

(63) Continuation of application No. 18/018,750, filed as application No. PCT/EP2021/070758 on Jul. 23, 2021, now Pat. No. 12,442,195.

(30) Foreign Application Priority Data

| | | |
|---|---|---|
| Jul. 31, 2020 | (NL) | 2026188 |
| Jul. 31, 2020 | (NL) | 2026189 |
| Sep. 28, 2020 | (NL) | 2026559 |

(51) Int. Cl.
*E04F 13/02* (2006.01)
*E04F 13/08* (2006.01)
(Continued)

(52) U.S. Cl.
CPC .... *E04F 15/02038* (2013.01); *E04F 13/0894* (2013.01); *E04F 13/14* (2013.01);
(Continued)

(58) Field of Classification Search
CPC ..... E04F 15/02038; E04F 13/0894; E04F 13/076; E04F 13/0889; E04F 2201/0146; E04F 2201/023; E04F 2201/042; E04F 2201/043; E04F 2201/0153; E04F 2201/0161; E04F 2201/0169;
(Continued)

(56) References Cited

U.S. PATENT DOCUMENTS

| | | | | |
|---|---|---|---|---|
| 4,037,377 A * | 7/1977 | Howell | E04C 2/296 | 52/592.1 |
| 6,505,452 B1 * | 1/2003 | Hannig | E04F 15/04 | 52/592.4 |

(Continued)

FOREIGN PATENT DOCUMENTS

| | | |
|---|---|---|
| DE | 102005012827 B3 | 7/2006 |
| EP | 3031998 A1 | 6/2016 |

(Continued)

*Primary Examiner* — Kyle J. Walraed-Sullivan
(74) *Attorney, Agent, or Firm* — The Webb Law Firm

(57) ABSTRACT

The present invention relates to a panel suitable as a floor, ceiling or wall panel, which panel is of a planar design having an upper side, a bottom side and side edges. Furthermore, the invention relates to a covering comprising a plurality of interconnected panels according to the invention. The invention also relates to a method of uncoupling two (or more) interconnected panels.

18 Claims, 7 Drawing Sheets

(51) Int. Cl.
*E04F 15/02* (2006.01)
*E04F 13/14* (2006.01)
*E04F 15/08* (2006.01)

(52) U.S. Cl.
CPC ..... *E04F 15/08* (2013.01); *E04F 2201/0146* (2013.01); *E04F 2201/023* (2013.01); *E04F 2201/042* (2013.01); *E04F 2201/043* (2013.01)

(58) Field of Classification Search
CPC ..... E04F 2201/0176; E04F 2201/0184; E04F 2201/0192; E04F 2201/02; E04F 2201/027; E04F 2201/03
See application file for complete search history.

(56) References Cited

U.S. PATENT DOCUMENTS 6,647,690 B1 * 11/2003 Martensson ..... E04F 15/04 52/489.1
7,874,118 B2 * 1/2011 Schitter ..... B44C 5/043 52/581
9,574,354 B2 2/2017 Stevens, Jr.
9,885,187 B2 2/2018 Kell
9,938,727 B2 * 4/2018 Ceysson ..... E04F 15/02038
10,190,611 B2 1/2019 Hannig
10,619,358 B2 * 4/2020 Segaert ..... E04F 15/105
10,738,477 B2 8/2020 Hannig
11,208,814 B2 * 12/2021 De Rick ..... E04F 15/10
11,225,800 B2 1/2022 De Rick et al.
11,242,687 B2 * 2/2022 Boucké ..... B32B 3/06
11,377,856 B2 7/2022 Boucké
2002/0020127 A1 * 2/2002 Thiers ..... E04C 2/10 52/578
2004/0128934 A1 * 7/2004 Hecht ..... E04F 15/02 52/578
2004/0218934 A1 11/2004 Silverbrook
2008/0110125 A1 * 5/2008 Pervan ..... E04C 2/38 52/582.2
2010/0300029 A1 12/2010 Braun
2011/0131909 A1 * 6/2011 Hannig ..... E04F 15/02 52/309.1
2011/0138722 A1 * 6/2011 Hannig ..... E04F 15/02033 52/309.1
2011/0277406 A1 * 11/2011 Kang ..... E04F 15/22 52/309.3
2013/0180193 A1 * 7/2013 Bossuyt ..... E04F 15/02 52/309.1
2013/0309441 A1 * 11/2013 Hannig ..... F16B 5/008 29/428
2014/0033633 A1 * 2/2014 Kell ..... E04F 13/26 403/348
2014/0215946 A1 * 8/2014 Roy ..... E04F 15/02 52/309.1
2014/0325930 A1 * 11/2014 Schneider ..... E04F 15/02038 52/588.1
2015/0240500 A1 * 8/2015 Stevens, Jr. ..... E04F 15/107 52/588.1
2016/0201336 A1 * 7/2016 Pervan ..... B26D 3/065 52/582.2
2017/0067261 A1 * 3/2017 Hannig ..... E04F 15/02038
2017/0241136 A1 * 8/2017 Kell ..... E04F 15/02038
2017/0284105 A1 10/2017 Ceysson
2017/0370109 A1 * 12/2017 Devos ..... E04F 15/02038
2018/0002935 A1 * 1/2018 Devos ..... B32B 5/18
2018/0010342 A1 * 1/2018 Van Hooydonck ... E04F 15/105
2018/0094441 A1 * 4/2018 Boo ..... E04F 15/02038
2019/0017278 A1 * 1/2019 De Rick ..... E04F 15/105
2019/0211569 A1 * 7/2019 Boo ..... E04F 15/102
2019/0271164 A1 9/2019 Devos
2020/0208410 A1 * 7/2020 Bjorkman ..... C09D 15/00
2020/0232226 A1 7/2020 De Rick
2020/0270874 A1 * 8/2020 Dürnberger ..... E04F 15/02033
2022/0025656 A1 * 1/2022 Carpentier ..... E04F 13/0894
2022/0034097 A1 * 2/2022 Boucké ..... B32B 5/18
2023/0015897 A1 * 1/2023 Markovski ..... E04F 15/02038
2023/0016968 A1 * 1/2023 Devos ..... E04F 15/02038
2023/0193636 A1 * 6/2023 Hannig ..... E04F 15/02033 52/588.1
2023/0258004 A1 * 8/2023 Brouckaert ..... B27M 3/04 428/131
2023/0287690 A1 * 9/2023 Brouckaert ..... B44F 9/02
2023/0304301 A1 * 9/2023 Boucké ..... E04F 15/105
2023/0366210 A1 * 11/2023 Boucké ..... E04F 15/02016
2023/0374793 A1 * 11/2023 Hannig ..... E04F 15/02016
2024/0125129 A1 * 4/2024 Fahle ..... E04F 15/02038
2024/0141655 A1 * 5/2024 Gutkowski ..... E04F 15/02038
2024/0229452 A1 * 7/2024 Quist ..... E04B 1/6116
2024/0309649 A1 * 9/2024 Boucké ..... E04F 13/0866

FOREIGN PATENT DOCUMENTS

EP 3597836 A1 1/2020
JP 2014510202 A 4/2014
WO 2014033628 A1 3/2014
WO 2016113677 A1 7/2016
WO 2017115202 A1 7/2017
WO 2018215550 A1 11/2018
WO 2019137964 A1 7/2019
WO 2019138365 A1 7/2019
WO 2020115415 A1 6/2020
WO 2020234711 A1 11/2020
WO 2021111210 A1 6/2021

* cited by examiner

PANEL, COVERING, AND METHOD OF UNCOUPLING TWO INTERCONNECTED PANELS

CROSS-REFERENCE TO RELATED APPLICATIONS

This application is a continuation of U.S. patent application Ser. No. 18/018,750 filed Jul. 23, 2021, which is the United States national phase of International Application No. PCT/EP2021/070758 filed Jul. 23, 2021, and claims priority to The Netherlands Patent Application Nos. 2026188 filed Jul. 31, 2020, 2026189 filed Jul. 31, 2020, and 2026559 filed Sep. 28, 2020, the disclosures of which are hereby incorporated by reference in their entireties.

BACKGROUND OF THE INVENTION

Field of the Invention

The present invention relates to a panel suitable as a floor, ceiling or wall panel, which panel is of a planar design having an upper side, a bottom side and side edges. Furthermore, the invention relates to a covering comprising a plurality of interconnected panels according to the invention. The invention also relates to a method of uncoupling two (or more) interconnected panels.

Description of Related Art

In the technological art panels have been proposed that can be coupled to each other in one common plane order to construct a covering of coupled panels that requires no additional adhesives. Such a covering of coupled panels that extend in one common plane is generally referred to as a floating covering. A particular development in the art, relates to panels having mutually interacting profiles that establish an interlocking in a direction both in the common plane of the panels and perpendicular to the common plane, which are commonly referred to respectively as a horizontal locking and a vertical locking.

In a still further development of such panels, the applicant has developed profiles which allow for a coupling of a first panel with a second identical panel by a by a vertical insertion of the mutually interacting profile of the first panel into the mutually interacting profile of the second panel. This technique is in the field also referred to as a drop-down coupling of panels, wherein one panel is positioned on a substrate to be covered, and another panel is coupled to the one panel by a vertical movement towards it.

In practice, it has been found that the drop-down movement of the profiles towards each other is attractive for a user in terms of expediency, and ease of establishing a robust coupling. Still, it has been experienced that the uncoupling of these panels is less straight-forward, for instance when a panel has to be replaced, or positioned differently. Although the panels allow for an uncoupling by a reverse movement, i.e. a vertically extraction of the panel that has been moved downward before in order to create a coupling, such a reverse movement is cumbersome and has related disadvantages. In particular, the vertically extracting of the panel requires a substantial force to dislodge the vertical interlocking properties of the interacting profiles, and hence entails the risk of damage of the mutually interacting profiles. In other words, the uncoupling of the panels by a vertical extraction, leaves room for improvement.

SUMMARY OF THE INVENTION

The objective of the present invention is therefore to further improve the panels known from the art, in particular with regard to the uncoupling properties of the mutually interacting profiles of two panels that are coupled to each other.

The above objective is accomplished by a first aspect of the invention which relates to:

- a, preferably planar, panel suitable as a floor, ceiling or wall panel, which having an upper side, a bottom side and side edges which comprise a first side edge provided with a first profile and a second side edge provided with a second profile,
- wherein the first profile and the second profile are mutually interacting profiles that can be coupled to each other, so that a first panel can be coupled in one common plane to a second, identical panel by the mutually interacting profiles,
- wherein the first profile and the second profile in coupled condition establish an interlocking with each other both in a horizontal direction and in a vertical direction. Preferably, the first profile and the second profile are configured to allow for:
- a coupling of the mutually interacting profiles of the first panel and the second panel by a vertical insertion of the mutually interacting profile of the second panel into the mutually interacting profile of the first panel (and/or vice versa), and
- an uncoupling of the first panel when coupled to the second panel, by a downward and/or upward angling movement between the first panel and the second panel out of the common plane.

It has been found that the uncoupling by an angling movement, preferably a downward angling movement, is a more gradual and smooth process than the reversed vertical extraction of the coupled, mutually interacting profiles. In particular it was found that by the angling movement it is possible to avoid relatively high resistances that may occur during the dislodging of the interlocking features of the coupled profiles. As a result, the angling movement thus accomplishes that relatively high extraction forces are avoided and thus the risk of damage of the panels during uncoupling is reduced.

In the context of the present invention, it is noted that the term vertical or vertical direction is meant as perpendicular to the common plane (defined by interconnected panels), and the term horizontal or horizontal direction is meant as parallel to the common plane (defined by interconnected panels). The expression vertical insertion can either be considered as an entirely vertical linear displacement of one panel with respect to another panel or can be considered as a movement of one panel with respect to the other, wherein the movement direction of the second profile of a first panel with respect to the first profile of a second panel has a vertical component. This can also be referred to as a downward motion or drop-down motion. Such coupling is also possible when panels, in particular the second profile and first profile, are connected through a zipping or scissoring motion.

In regard of the invention, the angling movement is more in particular a downward angling movement with respect to the common plane.

It is preferred in the panel according to the invention, that the first and second profile are essentially complementary profiles.

As such, the profiles accomplish a solid connection, wherein the occurrence of play between panels, and relative shifting of the relative positions of the coupled panels is avoided.

It is noted in general that the first profile and the second profile are essentially complementary, so that they are kept in a permanent position because their surface areas are in abutting contact with each other. Still, it is envisaged in the invention that some opposing surface areas of the first and second profile are not in abutting contact when coupled together. These non-abutting areas allow for small interstitial, preferably banana-shaped, spaces between the two coupled profiles which spaces are also referred to as a dust chambers and are generally advantageous for collecting ambient dust which is kept away from the abutting surfaces of the coupled profiles. Said interstitial spaces preferably span over a gap width, which gap width extends over at least a quarter of the width of the groove, even more preferably over at least a third of the width of the groove, even more preferably over at least half of the width of the groove.

In the panel according to the invention, it is particularly preferred, that:

- the first profile is provided along the first side edge of the panel, and comprises an upward tongue which is connected to the first side edge by a lower bridge part extending parallel to the plane of the panel at the bottom side of the panel, and wherein the lower bridge part delimits a upward groove which is enclosed between the upward tongue and the first side edge; and
- the second profile is provided along the second side edge of the panel, comprises a downward tongue which is connected to the second side edge by an upper bridge part extending parallel to the plane of the panel at a top side of the panel, and wherein the upper bridge part delimits an downward groove which is enclosed between the downward tongue and the second side edge;
- further wherein the first groove and the second groove are configured to receive respectively the downward tongue and the upward tongue when the respective mutually interacting profiles of two identical panels are coupled to each other.

The above specific configurations of the first and second profile have been proven to be highly expedient in accomplishing an attractive type of horizontal and vertical interlocking.

In the panel according to the invention, it is further preferred that the surface of the upward tongue that borders on the downward groove, comprises an interlocking surface area which is angled upwards and towards the downward groove, at an angle of 1 to 20 degrees, preferably 3 to 20 degrees, more preferably 5 to 20 degrees with respect to an upward vertical vector of the panel, when measured in a vertical plane perpendicular to the side edge,

- and wherein the surface of the downward tongue that borders on the upward groove, comprises an interlocking surface area which is angled upwards and away from the upward groove, at an angle of 1 to 20 degrees, preferably 3 to 20 degrees, more preferably 5 to 20 degrees with respect to an upward vertical vector of the panel, when measured in a vertical plane perpendicular to the side edge,
- wherein, when the mutually interacting profiles of two identical panels are coupled to each other, the interlocking surface areas of the upward tongue and the downward tongue interact with each other such that a vertical interlocking is achieved.

It has been found that the use of such interlocking surface areas, are highly suitable for allowing a coupling by vertical insertion, and an uncoupling by an angling movement. Said upward vertical vector may also be referred to as the normal vector, or the normal, in upward direction and which is perpendicular to a plane defined by the panel.

It is further preferred in the panel of the invention, that the interlocking surface areas of the downward tongue and the upward tongue are configured to be facing each other, preferably in abutting contact, when the first and second panel are in coupled condition.

In particular, it is preferred in the panel according to the invention that the interlocking surface areas are part of a curved surface of the downward tongue and the upward tongue, when viewed in a cross-sectional vertical plane perpendicular to the respective side edge.

The curved surfaces of the downward tongue and upward tongue contribute to mitigating resistance forces when uncoupling two coupled panels and allowing an angling movement at the same time.

In the above context of curved surfaces of both tongues, it is further preferred that:

- the curved surface of the downward tongue and the upward tongue has a convex form between the interlocking surface area and the top of the respective tongue, when viewed in a cross-sectional vertical plane perpendicular to the respective side edge.
- the curved surface of the downward tongue and the upward tongue, has a concave form between the interlocking surface area and the bottom of the corresponding upward groove and downward groove, when viewed in a cross-sectional vertical plane perpendicular to the respective side edge.

As an approximation of a curved surface, also envisaged by the invention is a surface composed of a multitude of planar surface areas which are in angled correlation to each other, when viewed in a cross-sectional vertical plane perpendicular to the respective side edge.

In another preferred embodiment of the panel according to invention, at least one of the interlocking surface areas of the downward tongue and the upward tongue, and preferably the interlocking surface area of the downward tongue, is provided with a malleable coating, in particular a wax coating.

The coating in general reduces the friction between the respective interlocking surface areas during coupling and uncoupling of the respective panels. The coating in particular contributes to a smooth uncoupling of two coupled panels by providing a reduced mechanical resistance during the angling movement. A wax coating has the advantage that the lipid compounds in the wax further work as a lubricant for the coupling and uncoupling of the panels.

In the panel according to the invention, it is preferred that an upper part of the first side edge of the first panel and an upper part of the downward tongue of the second side edge of the second panel comprise respective upper contact surfaces which are configured to be in abutting contact when the first and second panel are in coupled condition, which upper contact surfaces are substantially vertically oriented.

These upper contact surfaces cooperate with the interlocking surface areas, so that a vertical locking between the panels is established.

It is furthermore preferred that at least one of the upper contact surfaces of the first panel and the second panel is provided with a malleable coating, in particular a wax coating. The coating in general reduces the friction between the respective upper contact surfaces during coupling and uncoupling of the respective panels. The coating in particular contributes to a smooth uncoupling of two coupled panels by providing a reduced mechanical resistance during an angling movement. It is further imaginable that a top section of the upper contact surfaces together form a bevel and/or grout. This creates some space in the top section of a seam formed in between interconnected panels, which typically facilitates the uncoupling-by-downward-angling movement of the first and second profiles.

It is especially preferred in the panel according to the invention, that the panel comprises a first corner zone connecting a frontal side of the first side edge with the bottom side of the panel and a second corner zone connecting a frontal side of the second side edge with the bottom side of the panel, of which at least one corner zone is bevelled, preferably such that in a coupled condition of two panels a void is present between a corner zone of one panel and a corner zone of the other panel, wherein the void has the form of a wedge having a wedge angle of at least 15 degrees, preferably at least 30 degrees.

Such a void at the bottom side of the two coupled panels provides space for a downward angling movement during the uncoupling of two coupled panels. Preferably the first corner zone comprises a straight plane surface which extends from the bottom of the panel to a lower portion of the recess in the downward flank.

With respect to the above described corner zones being provided with a bevel, it is particularly preferred that:

- a corner zone at the first side edge is provided with a first bevel which is oriented under an angle of 5 to 45 degrees, preferably 5 to 30 degrees, with respect to a downward vertical vector of the panel and measured in a vertical plane perpendicular to the first side edge;

and/or that:

- a corner zone at the second side edge is provided with a second bevel which is oriented under an angle of 5 to 45 degrees, preferably 5 to 30 degrees, with respect to a downward vertical vector of the panel and measured in a vertical plane perpendicular to the second side edge.

In a preferred embodiment of the panel according to invention, a frontal side of the upward tongue of the first profile is provided with at least one locking element, said locking element preferably comprising at least one protrusion, and a horizontally opposed frontal side of the second profile is provided with at least one counterlocking element, said counterlocking element preferably comprising at least one recess, wherein the locking element, in particular the protrusion, and the counterlocking element, preferably the recess, are substantially complementary (form-fittingly), such that in a coupled condition of two panels, the protrusion of the first profile and the recess of the second profile mutually interlock.

In this embodiment it is beneficial if the protrusion protrudes in between two vertical surfaces of the upward tongue which are parallel but offset, wherein the lower vertical surface is positioned closer to the first side edge. The protrusion protrudes from the upper vertical surface outwards with an upper curved portion, which curve flattens downwardly. The upper portion of the protrusion is adjacent to a lower portion, which comprise a crease or kink in between the upper and lower portion. The lower portion preferably comprises a plane surface which is inclined with respect to the vertical surfaces. The lower portion extends downwardly from the upper portion to the lower vertical surface, wherein the lower portion and the lower vertical surface of the upward groove mutually enclose an angle between 100 and 175 degrees. The lower vertical surface preferably forms a crease with a planar surface which is angled with respect to the bottom of the panel and forms a second corner zone. The recess in the downward flank has a complementary shape to the protrusion. The recess preferably is situated between an upper vertical surface of the downward flank and an inclined surface of the downward flank. The recess comprises a curved upper portion which flattens downwardly. The curved upper portion is adjacent to a lower portion, which lower portion is a plane inclined surface. The plane inclined surface and the lower inclined surface of the upward groove mutually enclose an angle of in between 90 and 100 degrees, preferably substantially 95 degrees. The lower inclined surface forms the first corner zone.

Such a locking, in particular such a co-action between the recess and the protrusion, achieve an interlocking in a vertical direction when two panels are coupled, and further contributes to the angling (out) movement during uncoupling of two panels as set out below.

During the angling movement of two coupled panels out of the common plane, the upward tongue and downward tongue are dislodged from each other, while the protrusion and recess first remain interlocked and as such cooperate as a temporary hinge over which the respective panels are angled. Once the respective tongues are dislodged, it is possible to subsequently dislodge the protrusion and recess. The temporary hinging function of the protrusion and recess guides the angling movement in a way such that less dislodging force is required for the uncoupling of the panels.

It is further preferred that the protrusion and recess are provided at a vertically lower position than the interlocking surface areas. Such a position leads to a dislodging of the respective interlocking surface areas by a rotation of the downward tongue of one panel away from the opposed side edge of the other panel. Such a rotation away from the opposed side edge, minimizes the mechanical resistance during the angling movement.

It is additionally preferred that the surfaces of the protrusion and the recess are at least partly curved, when viewed in a vertical plane perpendicular to the side edge. The curved shape contributes to the temporary hinging function of the protrusion and recess, because it provides a more smooth angling movement.

In a preferred embodiment of the panel according to the invention, a frontal side of the upward tongue of the first profile is provided with at least one locking element, in particular a protrusion, and a horizontally opposed frontal side of the second profile is provided with a counterlocking element, in particular a recess, wherein the protrusion and the recess are substantially complementary, such that in a coupled condition of two panels, the locking element, in particular the protrusion, of the first profile and the counterlocking element, in particular the recess, of the second profile mutually interlock, and wherein (a locking surface of) the locking element and (a counterlocking surface of) the counterlocking element define at least one pivot point or at least one pivot zone around which, in coupled condition of the panels, the panels can be mutually angled downwardly during uncoupling of said first profile and the second profile. Preferably, the locking element and counterlocking element are configured to lock interconnected panels at least in vertical direction. It is imaginable that the pivot point is either a static pivot point or a dynamic (sliding) pivot point. In this latter case, the pivot point may shift during the angling out process (during uncoupling of interconnected panels). The pivot zone may either be a dynamic (sliding)

pivot point or may be formed by a plurality of—closely located but distant—pivot points. Preferably, the pivot point is located at a level below the deepest point of an upward groove enclosed by the upward tongue and the core of the panel. The locking surface of the locking element is typically defined by a (downwardly directed) lowest surface or bottom surface of the locking element. The counterlocking surface of the counterlocking element is configured to co-act with said locking surface to allow, besides a vertical locking effect, a desired pivoting movement between the panels in order to mutually uncouple the panels. Preferably, the locking surface is a flat surface. The counterlocking surface is typically defined by a(n) (upwardly directed) lowest surface or bottom surface of the locking element. Preferably, this counterlocking surface is flat. Each of the locking surface and counter locking surface preferably encloses an angle with the common plane. The locking surface and the counterlocking surface preferably extend in substantially the same direction. Preferably, the locking surface is upwardly inclined in a direction away from the core of the panel, and the counterlocking surface is downwardly inclined in a direction away from the core of the panel. Preferably, the locking element and counterlocking element is configured to merely co-act (contact) with each other at the locking surface and counterlocking surface. A remaining part of the locking element is preferably located at a distance from a remaining part of the counterlocking element. The locking surface and the counterlocking surface are preferably both located at a level below a deepest point of an upward groove situated in between the upward tongue and the core of the panel. This latter commonly significantly facilitates the uncoupling process.

Preferably, an upper part of the first side edge comprises a first, preferably substantially vertical, upper contact surface, and wherein an upper part of an outer side of the downward tongue of the second profile defines a second, preferably substantially vertical, upper contact surface, which first and second contact surfaces are configured to be in abutting contact when a first and a second panel are in coupled condition, and preferably such that a substantially watertight seam is created between said panels. In coupled condition, the first and second contact surfaces are preferably pushed towards each other, which leads to pretension between the contact surfaces, which is in favour of realizing a watertight seam in between the panels.

In a preferred embodiment of the invention—and more preferably considered in a cross-section of the panel, in particular a cross-section of the second profile—a first virtual line extending between the pivot point or pivot zone to a portion of the second upper contact surface defines a first radius of a first virtual angling out circle representative for the movement of the second profile with respect to the first profile during uncoupling, wherein at the intersection of said first virtual circle and the second upper contact surface portion an upwardly directed first tangent to said second upper contact surface portion points away from said first virtual circle. This allows the second profile, at least at the second upper contact surface, to be uncoupled substantially unhindered from the first upper contact surface (of an adjacent panel). Here, material deformation at the upper contact surfaces will not be needed, which is in favour of the uncoupling process.

Preferably, the first profile is provided along the first side edge of the panel, and comprises an upward tongue which is connected to the first side edge by a lower bridge part extending parallel to the plane of the panel at the bottom side of the panel, and wherein the lower bridge part delimits a upward groove which is enclosed between the upward tongue and an upward flank of the first side edge; and the second profile is provided along the second side edge of the panel, comprises a downward tongue which is connected to the second side edge by an upper bridge part extending parallel to the plane of the panel at a top side of the panel, and wherein the upper bridge part delimits an downward groove which is enclosed between the downward tongue and a downward flank of the second side edge; wherein the surface of the upward tongue that borders on the downward groove, comprises a first interlocking surface area which is angled upwards and towards the upward flank, and wherein the surface of the downward tongue that borders on the upward groove, comprises a second interlocking surface area which is angled upwards and away from the downward flank. This leads to a closed-groove configuration which contributes to realize a vertical locking between interconnected panels.

Preferably, in particular seen in a cross-section of the panel, in particular in a cross-section of two interconnected panels, a second virtual line extending between the pivot point or pivot zone to a portion of the second interlocking surface area defines a second radius of a second virtual angling out circle representative for the movement of the second profile with respect to the first profile during uncoupling, wherein the portion of the second interlocking surface area is chosen such that the second virtual circle intersects the upward tongue, and wherein at the intersection of said second virtual circle and the second interlocking surface area an upwardly directed second tangent to said second interlocking surface area points away from said second virtual circle. More preferably, the portion of the second interlocking surface area is chosen such that the second virtual circle intersects an outer surface of the upward tongue at at least two distant points. This embodiment requires that the second interlocking surface area will have to pass an obstacle formed by the upward tongue during angling out of the second profile with respect to the first profile. This means that, during uncoupling, the downward tongue and/or the upward tongue will have to be deformed, preferably temporarily, which renders the uncoupling process slightly more difficult, but which is in clear favour of mutually locking interconnected panels during use.

In a preferred embodiment, the side of the upward tongue facing towards the upward flank is the inside of the upward tongue and the side of the upward tongue facing away from the upward flank is the outside of the upward tongue, and wherein the side of the downward tongue facing towards the downward flank is the inside of the downward tongue and the side of the downward tongue facing away from the downward flank is the outside of the downward tongue, wherein the outside of the downward tongue and the upward flank both comprise an upper contact surface near or towards a top side of the panel, wherein said contact surfaces extend vertically at least partly, and wherein the upper contact surface of the outside of the downward tongue of said panel is configured to engage the upper contact surface of the upward flank of an adjacent panel, in coupled condition of said panels, wherein adjoining the upper contact surfaces both the downward tongue and the upward flank comprise an inclined or horizontal contact surface, wherein the inclined contact surface of the downward tongue of said panel is configured to engage the inclined or horizontal contact surface of the upward flank of an adjacent panel, in coupled condition of said panels, wherein each vertical part of the upper contact surface and each adjoining inclining surface preferably mutually enclose an angle ($\alpha$) between 100 and 175 degrees. Hence, adjoining, and typically directly adjoining or directly below, the upper contact surfaces preferably an inclined or horizontal contact surface is present, which is configured to create a connection or watertight seal or water barrier between the panels. The inclination is preferably such that, looking at the downward tongue, the inclined surface extends outwardly and, looking at the upward flank, the inclined surface extends inwardly. The inclination angle makes it such that the downward tongue thus has a protruding portion and the upward flank has a recessed portion, which in coupled condition are in contact and thus provide a vertical locking effect. The inclination also creates a slight labyrinth, which improves the waterproof properties of the connection. Typically, an inclined contact surface is preferred over a horizontal contact surface for the purpose of coupling and uncoupling the panels by a downward angling movement between the first panel and the second panel out of the common plane. Since the inclined contact surface is typically relatively small, uncoupling of the coupled panels by means of said downward angling movement can typically be realized in a relatively smooth manner. Preferably, the width of the inclined contact surface of the outer side of the downward tongue is less or equal to 0.16 mm, and is preferably between 0.08 and 0.16 mm. This secures sufficient contribution to a vertical locking effect, while at the same time still allowing the coupling profiles to be uncoupled smoothly by means of an angling movement.

Preferably, adjoining the inclined contact surface the downward tongue comprises an outer surface, situated below the inclined contact surface of the downward tongue, and wherein adjoining the inclined contact surface the upward flank comprises an inner surface, situated below the inclined contact surface of the upward flank, wherein the outer and inner surface run substantially parallel and extend at least partly in vertical direction, wherein, in coupled condition of adjacent panels, a space is present between at least a part of the outer surface of said panel and at least a part the inner surface of an adjacent panel. This space aims to prevent that any force exerted on or by the panels results in pushing the panels together anywhere else than at the upper contact surfaces and/or inclined contact surfaces. If the inner and outer surfaces would be in contact, they could prevent the upper contact surfaces to contact, which would be detrimental to the waterproof properties of the connection. At the top, at the upper contact surfaces and the inclined contact surfaces, the aim is thus to create a connection between the panels, whereas below these contact surfaces the aim is to avoid such connection.

The panel according to the invention, optionally comprises a third side edge which is provided with an identical first profile as provided on the first side edge, and a fourth side edge which is provided with an identical second profile as provided on the second side edge.

In the panel according to the invention, it is preferred that the first and second side edges are opposing, parallel side edges.

In case the panel comprises a third and fourth side edge provided with a first and second profile, it is preferred that these are also opposing, parallel side edges.

The panel according to the invention, is preferably of a rectangular, parallelogrammatic, or hexagonal shape. Preferably, the panel is an oblong panel.

It is further preferred that the panel according to the invention has a vertical thickness in the range of 3.0 mm to 20.0 mm, preferably in the range of 3.8 mm to 12.0 mm.

Preferably, the panel is a decorative panel, comprising: at least one core layer, and at least one decorative top section (or top structure), directly or indirectly affixed to said core layer, wherein the top section defines a top surface of the panel, a plurality of side edges at least partially defined by said core layer and/or by side top section, comprising said first side edge provided with said first profile and said second side edge provided with said second profile.

The top section preferably comprises at least one decorative layer affixed, either directly or indirectly, to an upper surface of the core layer. The decorative layer may be a printed layer, and/or may be covered by at least one protective (top) layer covering said decorative layer. The protective layer also makes part of the decorative top section. The presence of a print layer and/or a protective layer could prevent the tile to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The panels according to the invention are for example at least partially made from magnesium oxide, or are magnesium oxide based. The panel according to the invention may comprise: a core provided with an upper side and a lower side, a decorative top structure (or top section) affixed, either directly or indirectly on said upper side of the core, wherein said core comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may embedded in said composite layer. The core composition may also comprise magnesium chloride leading to a magnesium oxychloride (MOC) cement, and/or magnesium sulphate leading to magnesium oxysulphate (MOS) cement.

It has been found that the application of a magnesium oxide and/or magnesium hydroxide based composition, and in particular a magnesia cement, including MOS and MOC, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use.

As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix.

The magnesia based composition, in particular the magnesia cement, may comprise magnesium chloride ($MgCl_2$). Typically, when magnesia (MgO) is mixed with magnesium chloride in an aqueous solution, a magnesia cement will be formed which comprises magnesium oxychloride (MOC). The bonding phases The bonding are $Mg(OH)_2$, $5Mg(OH)_2 \cdot MgCl_2 \cdot 8H_2O$ (5-form), $3Mg(OH)_2 \cdot MgCl_2 \cdot 8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 N/mm2. The surface hardness of MOC is preferably 50-250 N/mm2. The E-Modulus is preferably 1-3 104 N/mm2. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development. Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot 3CO_3 \cdot 4H_2O$, which is insoluble and enables the cement to maintain structural integrity.

The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution MgO reacts with $MgSO_4$, which leads to magnesium oxysulfate cement (MOS), which has very good binding properties. In MOS, $5Mg(OH)_2 \cdot MgSO_4 \cdot 8H_2O$ is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulfur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system MgO—$MgSO_4$-$H_2O$ at different temperatures between of 30 and 120 degrees Celsius $5Mg(OH)_2 \cdot MgSO_4 \cdot 3H_2O$ (513 phase), $3Mg(OH)_2 \cdot MgSO_4 \cdot 8H_2O$ (318 phase), $Mg(OH)_2 \cdot 2MgSO_4 \cdot 3H_2O$ (123 phase), and $Mg(OH)_2 \cdot MgSO_4 \cdot 5H_2O$ (115 phase). Normally, the 513 phase and 318 phase could only be obtained by curing cement under saturated steam condition when the molar ratio of MgO and $MgSO_4$ was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro) structure comprising a needle-like structure. This can be verified by means of SEM analysis. The magnesium oxysulfate ($5Mg(OH)_2 \cdot MgSO_4 \cdot 3H_2O$) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the $5Mg(OH)_2 \cdot MgSO_4 \cdot 3H_2O$ (513-phase). This preferred embodiment will provide a magnesia cement having sufficient mechanical strength for use in the core layer of a floor panel.

The crystal phase of MOS is adjustable by modifying the MOS by using an organic acid, preferably citric acid and/or by phosphoric acid and/or phosphates. During this modification new MOS phases can obtained, which can be expressed by 5Mg(OH)2·MgSO4·5H2O (515 phase) and Mg(OH)2·MgSO4·7H2O (517-phase). The 515 phase is obtainable by modification of the MOS by using citric acid. The 517 phase is obtainable by modification of the MOS by using phosphoric acid and/or phosphates (H3PO4, KH2PO4, K3PO4 and K2HPO4). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises 5Mg(OH)2·MgSO4·5H2O (515 phase) and/or Mg(OH)2·MgSO4·7H2O (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form H2PO4−, HPO42−, and/or PO43−, wherein these anions adsorb onto [Mg(OH)(H2O)x]+ to inhibit the formation of Mg(OH)2 and further promote the generation of a new magnesium subsulfate phase, leading to the compact structure, high mechanical strength and good water resistance of MOS cement. The improvement produced by adding phosphoric acid or phosphates to MOS cement follows the order of H3PO4=KH2PO+>>K2HPO4>>K3PO4. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 N/mm2.

The magnesium cement composition preferably comprises one or more silicone based additives. Various silicone based additives can be used, including, but not limited to, silicone oils, neutral cure silicones, silanols, silanol fluids, silicone (micro) spheres, and mixtures and derivatives thereof. Silicone oils include liquid polymerized siloxanes with organic side chains, including, but not limited to, polymethylsiloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more crosslinkers (e.g., silicone based crosslinkers) can also be used. The viscosity of the one or more silicone based additives (e.g., silicone oil, neutral cure silicone, silanol fluid, siloxane polymers, etc.) may be about 100 cSt (at 25° C.), which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired.

In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight.

It is imaginable that one or more crosslinkers are used in the magnesia cement. In some embodiments, the crosslinkers are silicone based crosslinkers. Exemplary crosslinkers include, but are not limited to, methyllrimethoxysilane, methyltriethoxysilane, methyltris (methylethylketoximino) silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including 3Mg(OH)2·MgCl2·8H2O (phase 3) and 5Mg(OH)2·MgCl2·8H2O (phase 5) crystalline structures. In some situations, higher percentages of the 5Mg(OH)2·MgCl2·8H2O (phase 5) crystalline structure is preferred. In such situations, the addition of one or more silicone based additives to the magnesium oxychloride cement compositions can stabilize the curing process which can increase the percentage yield of 5Mg(OH)2·MgCl2·8H2O (phase 5) crystalline structures. For example, in some embodiments, the magnesium oxychloride compositions comprising one or more silicone based additives can cure to form greater than 80% 5Mg(OH)2·MgCl2·8H2O (phase 5) crystalline structures. In other embodiments, the magnesium oxychloride compositions comprising one or more silicone based additives can cure to form greater than 85% 5Mg(OH)2·MgCl2·8H2O (phase 5) crystalline structures. In yet other embodiments, the magnesium oxychloride compositions comprising one or more silicone based additives can cure to form greater than 90% 5Mg(OH)2·MgCl2·8H2O (phase 5) crystalline structures. In yet other embodiments, the magnesium oxychloride compositions comprising one or more silicone based additives can cure to form greater than 95% 5Mg(OH)2·MgCl2·8H2O (phase 5) crystalline structures. In yet other embodiments, the magnesium oxychloride compositions comprising one or more silicone based additives can cure to form greater than 98% 5Mg(OH)2·MgCl2·8H2O (phase 5) crystalline structures. In yet other embodiments, the magnesium oxychloride compositions comprising one or more silicone based additives can cure to form about 100% 5Mg(OH)2·MgCl2·8H2O (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm.

For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking.

The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibers, including, but not limited to, paper fibers, wood fibers, polymeric fibers, organic fibers, and fiberglass. The magnesium oxychloride cement compositions can also form structures that are UV stable, such that the colour and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride (MgCl¬2 (aq)), and one or more silicone based additives. Instead of aqueous magnesium chloride (MgCl2) magnesium chloride (MgCl2) powder can also be used. For example, magnesium chloride (MgCl2) powder can be used in combination with an amount of water that would be equivalent or otherwise analogous to the addition of aqueous magnesium chloride (MgCl2 (aq)).

In certain embodiments, the ratio of magnesium oxide (MgO) to aqueous magnesium chloride (MgCl2 (aq)), if applied, in the magnesium oxychloride cement composition can vary. In some of such embodiments, the ratio of magnesium oxide (MgO) to aqueous magnesium chloride (MgCl2 (aq)) is between about 0.3:1 and about 1.2:1, by weight. In other embodiments, the ratio of magnesium oxide (MgO) to aqueous magnesium chloride (MgCl2 (aq)) is between about 0.4:1 and about 1.2:1, by weight. And in yet other embodiments, the ratio of magnesium oxide (MgO) to aqueous magnesium chloride (MgCl2 (aq)) is between about 0.5:1 and about 1.2:1, by weight.

The aqueous magnesium chloride (MgCl2 (aq)) can be described as (or otherwise derived from) a magnesium chloride brine solution. The aqueous magnesium chloride (MgCl2 (aq)) (or magnesium chloride brine) can also include relatively small amounts of other compounds or substances, including but not limited to, magnesium sulphate, magnesium phosphate, hydrochloric acid, phosphoric acid, etcetera.

In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, It is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly (lactic-co-glycolic acid) (PLGA), poly (lactic acid) (PLA), poly (glycolic acid) (PGA), the family of polyhydroxyalkanoates (PHA), polyethylene glycol (PEG), polypropylene glycol (PPG), polyesteramide (PEA), poly (lactic acid-co-caprolactone), poly (lactide-co-trimethylene carbonate), poly (sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols in the end. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core may be solid or foamed, or both in case the core is composed of a plurality of parts/layers.

It may be advantageous in case the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape. Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer, that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50% w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

In a second aspect, the invention relates to a covering for a floor, ceiling or wall, which is constituted by a multitude of coupled panels according to the first aspect of the invention.

A third aspect of the invention relates to a method of uncoupling two identical panels which are coupled to each other in a common plane by two mutually interacting profiles, wherein the panels are defined by the first aspect of the invention, the method comprising the step of uplifting of one of the two panels out of the common plane, during which uplifting the two mutually interacting profiles accomplish a downward angling movement between the two panels out of the common plane.

The method accomplishes the same advantages as set out above of a smooth uncoupling of two coupled panels with lowered mechanical resistance which reduces the risk of damage during uncoupling.

In the method according to the invention, it is beneficial when the mutually interacting profiles achieve a downward angling movement between the panels out of the common plane by an angle of at least 15 degrees, preferably 25-30 degrees.

Furthermore, it is preferred in the method according to the invention, that the interlocking in a vertical direction of the mutually interacting profiles is dislodged by the downward angling movement, before the horizontal interlocking of the mutually interacting profiles is dislodged.

More in particular it is preferred in the method according to the invention, that the vertical interlocking by the interlocking surface areas of the downward tongue and the upward tongue is dislodged, before the horizontal interlocking of the mutually interacting profiles is dislodged.

With special preference, it is included in the method of the invention that the one panel is uplifted at one of the side edges that is provided with a profile having an upward tongue.

In this way, the uplifting is most effective in achieving the angling movement, while minimizing the risk of any damage during the dislodging the interlocking surface areas.

BRIEF DESCRIPTION OF THE DRAWINGS

The invention will be further elucidated with reference to preferred embodiments of the invention that are shown in the appended figures, wherein.

DESCRIPTION OF THE INVENTION

Figure 1:
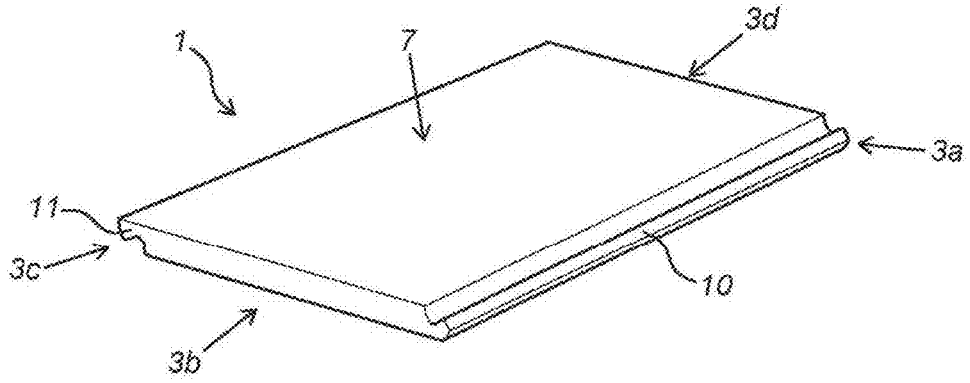
FIG. 1 shows in perspective a panel according to the invention.

FIG. 1 shows a panel 1 suitable as a floor, ceiling or wall panel, which panel is of a planar design having an upper side 7, a bottom side and side edges 3*a-d* which comprise a first side edge 3*a* provided with a first profile 10 and a second side edge 3*c* provided with a second profile 11.

Figure 2:
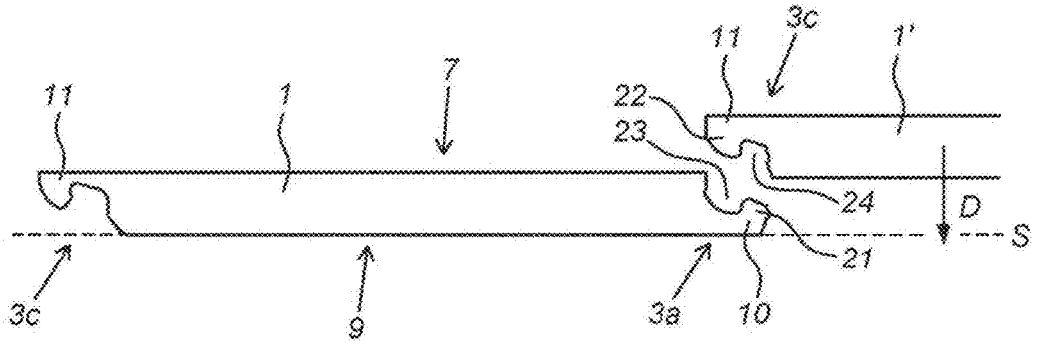
FIG. 2 shows a cross-sectional view of two panels according to the invention.

FIG. 2 shows a cross-section of the panel 1 of FIG. 1, perpendicular to the first and second side edges 3*a* and 3*c*, which are provided with a first profile 10 and a second profile 11. The bottom side 9 of the panel 1, is laid on a substrate layer for instance a floor surface S. Another identical panel 1' is shown in part, of which the second side edge 3*c* is to be coupled to the panel 1, by a downward vertical movement indicated by vector D.

The first profile 10 and the second profile 11 of both panels 1 and 1' are mutually interacting profiles that can be coupled to each other. During coupling, the second profile 11 of panel 1' is vertically inserted in the first profile 10 of panel 1, which involves the downward tongue 22 of panel 1' being inserted in the first groove 23 of panel 1, and the upward tongue 21 of panel 1 being inserted in the second groove 24 of panel 1'. When coupled, the panels 1 and 1' lie in a common plane which is parallel to the floor surface S.

Figure 3:
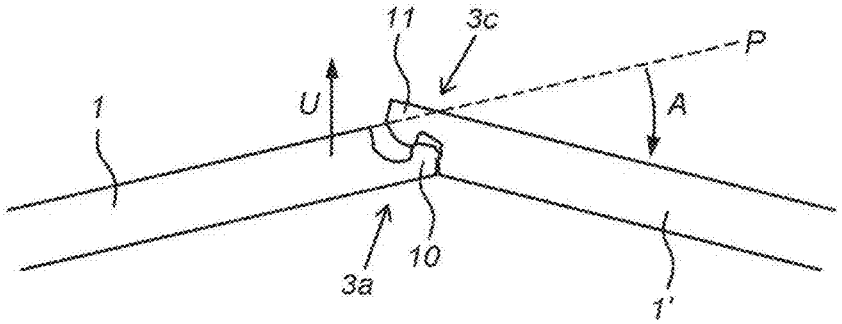
FIG. 3 shows a cross-sectional view of two coupled panels that are uncoupled by an angling movement.

FIG. 3 shows panels 1 and 1' during a process of uncoupling according to the invention, after being coupled in accordance with the method shown in FIG. 2. By uplifting the panel 1 at the side edge 3*a* from the substrate layer along a vector U, the first profile 10 in cooperation with the second profile 11 of panel 1' accomplish a hinging movement, so that panel 1' makes a downward angling movement over an angle A out of the common plane P in which both panels were lying when in coupled condition. As such, a vertical extraction of second profile 11 from first profile 10 is no longer needed and can thus be avoided.

Figure 4:
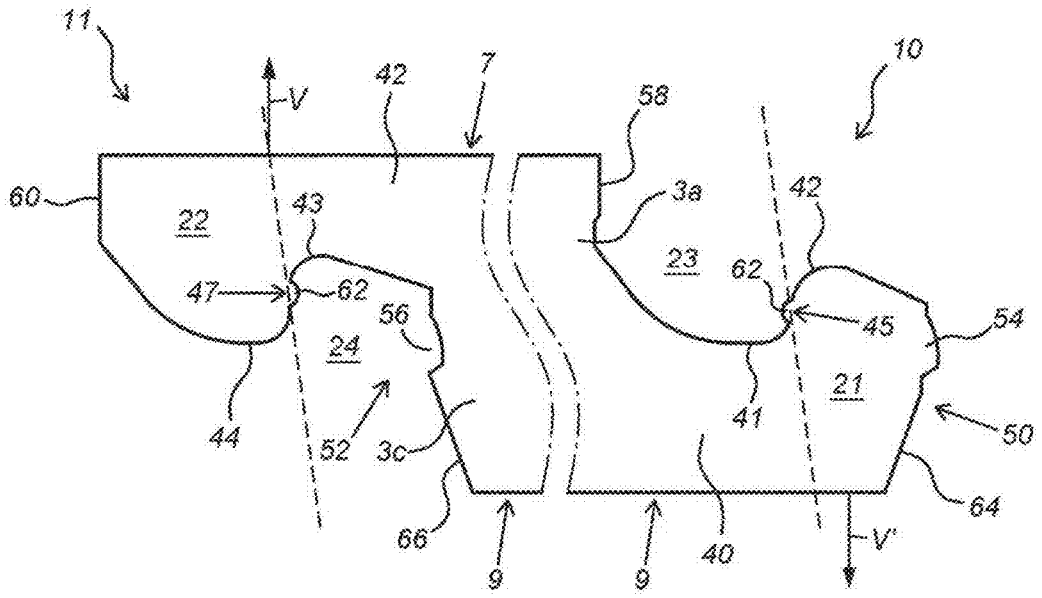
FIG. 4 shows in cross-section details of two mutually interacting profiles according to the invention.

FIG. 4 shows in detail a preferred embodiment of the first profile 10 and second profile 11 provided at the first side edge 3*a* and the second side edge 3*c*, which is advantageously applied in a panel shown in the preceding FIGS. 1-3.

The first profile 10 comprises an upward tongue 21 which is connected to the first side edge 3*a* by a lower bridge part 40 extending parallel to the plane of the panel at the bottom side 9 of the panel, and wherein the lower bridge part 40 delimits a upward groove 23 is enclosed between the upward tongue 21 and the first side edge 3*a*, wherein the upward groove 23 has a bottom 41; and the second profile 11 comprises a downward tongue 22 which is connected to the second side edge 3*c* by an upper bridge part 42 extending parallel to the plane of the panel at a top side 7 of the panel, and wherein the upper bridge part 42 delimits an downward groove 24, which is enclosed between the downward tongue and the second side edge, wherein the downward groove 24 has a bottom 43.

The surface of the upward tongue 21 that borders on the upward groove 23, comprises an interlocking surface area 45 which is angled upwards and towards the upward groove 23 (as indicated by the respective dotted line), at an angle of 5 to 20 degrees with respect to an upward vertical vector V of the panel, when measured in a vertical plane perpendicular to the side edge 3*a*. The surface of the downward tongue 22 that borders on the downward groove 24, comprises an interlocking surface area 47 which is angled upwards and away from the downward groove (as indicated by the respective dotted line), at an angle of 5 to 20 degrees with respect to an upward vertical vector of the panel, when measured in a vertical plane perpendicular to the side edge 3*c*.

The curved surface of the upward tongue 22 and the downward tongue 23 has a convex form between the interlocking surface area 45 resp. 47, and the top 42 resp. 44 of the respective tongues, when viewed in a cross-sectional vertical plane perpendicular to the side edges 3*a* resp. 3*c*.

Furthermore, the curved surface the upward tongue 22 and the downward tongue 23 has a concave form between the interlocking surface area 45 resp. 47, and the bottom 41 resp. 43 of the respective upward groove 23 and downward groove 24, when viewed in a cross-sectional vertical plane perpendicular to the respective side edges 3*a* resp. 3*c*.

A frontal side 50 of the upward tongue 21 of the first profile 10 is provided with a protrusion 54, and a horizontally opposed frontal side 52 of the second profile 11 is provided with a recess 56, wherein the protrusion 54 and the recess 56 are substantially complementary, so that both mutually interlock in a coupled condition of two identical panels 1 and 1'. The first profile 10 and second profile 11 comprise upper contact surfaces 58 resp. 60, which provide for an abutting contact at the top side 7 in a coupled condition of two identical panels 1 and 1'.

The interlocking surface areas 45 and 47 are provided with a malleable coating 62 (thickness is exaggerated for clarity), such as a wax coating.

Further a first corner zone 64 connecting the frontal side 50 of the first side edge 3*a* with the bottom side 9 of the panel and a second corner zone 66 connecting a frontal side 52 of the second side edge with the bottom side 9 of the panel are bevelled. With respect to a downward vertical vector V', the corner zones 64 and 66 are bevelled under an angle of 5 to 30 degrees, for instance 20 degrees such as depicted.

Figure 5:
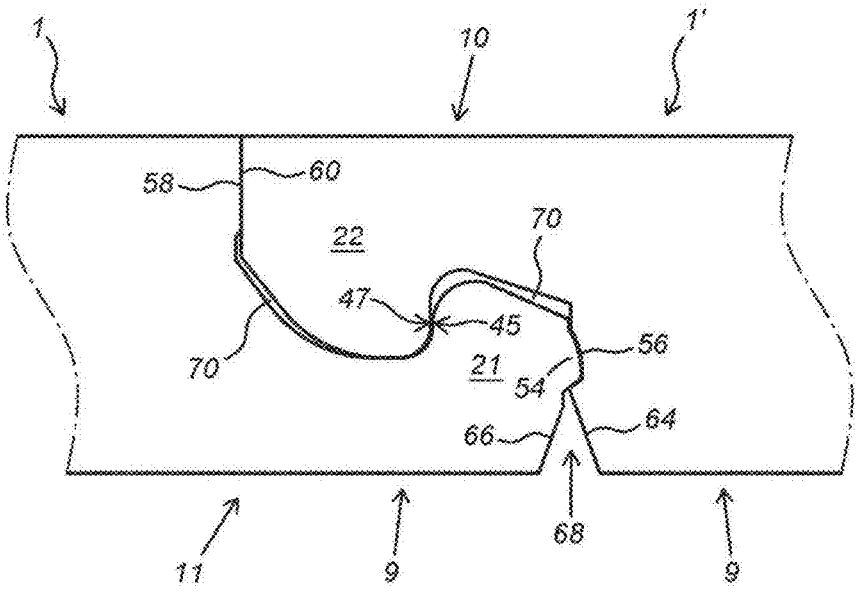
FIG. 5 shows the two profiles of FIG. 4 in a coupled condition in a common plane.

FIG. 5 shows first and second profiles 10 and 11, which are identical to those depicted in FIG. 4, and which are brought in a coupled condition that is achieved by coupling two identical panels 1 and 1' as shown in FIG. 2. Identical features of the profiles that are shown in FIG. 4, are indicated by the same reference numerals.

The first profile 10 and the second profile 11 establish an interlocking with each other in a horizontal direction and in a vertical direction, by virtue of the cooperating tongues 21 and 22, the cooperating protrusion 54 and recess 56, and the upper contact surfaces 58, 60, wherein these pairs of cooperating features are in abutting contact with each other. Herein, the opposed interlocking surface areas 45 and 47 of the cooperating tongues 21 and 22 establish an the interlocking in vertical direction due to their angled orientation with respect to the upward vertical vector.

The first and second profiles 10 and 11 are essentially complementary, so that they are kept in a permanent position to each other because of the cooperating features described above. In addition, some opposing surface areas of the first and second profile 10 and 11 are not in abutting contact with each other, which allows for small interstitial spaces 70 between the two coupled profiles, which spaces 70 function as dust chambers.

By virtue of the bevelled corner zones 64 and 66, a void 68 is present at the interface of bottom sides 9 of two coupled panels, which void 68 has the form of a wedge having a wedge angle of about 40 degrees.

Figure 6:
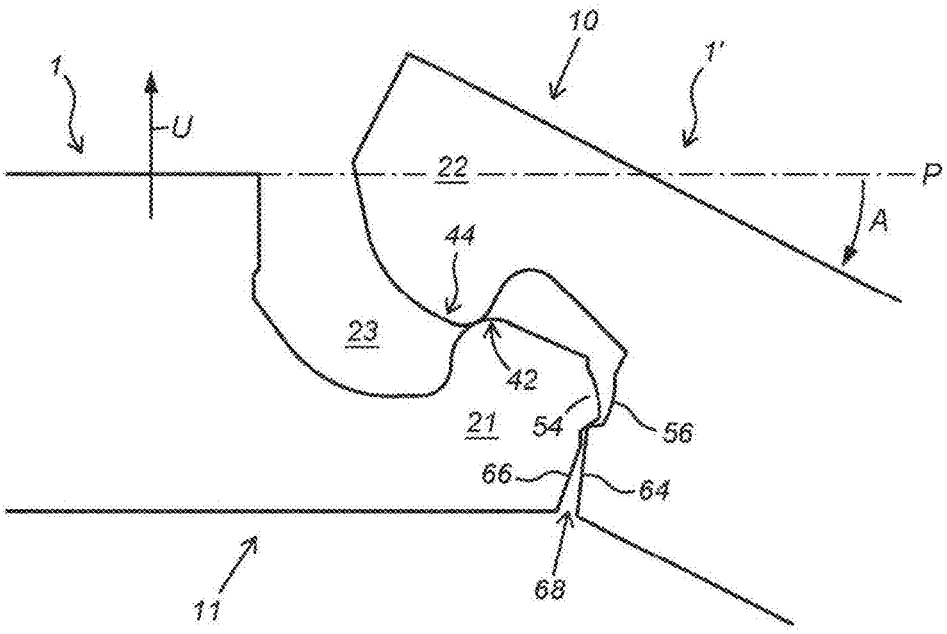
FIG. 6 shows the two profiles of FIG. 4 that are uncoupled by an angling movement.

FIG. 6 shows the identical profiles 10 and 11 as shown in FIG. 5 of two identical panels 1 and 1', which are uncoupled by an angling movement over an angle A, which uncoupling is more generally shown in FIG. 3.

In the stage of uncoupling shown, the angling movement dislodges the downward tongue 22 from the first upward groove 23, while the protrusion 54 and recess 56 remain in abutting contact and together function as a temporary hinge by which the angling movement is guided, when the panel 1 is uplifted along vector U. Consequently, the panel 1' makes a downward angling movement over an angle A out of the common plane P in which both panels were lying when in coupled condition. By the angling movement the bevelled corner edges 64 and 66 are brought closer to each other, and hence the size of the wedge-formed void 68 between the two panels 1 and 1' is reduced.

In a subsequent step, the panels 1 and 1' may be completely uncoupled by a movement of panel 1' in the common plane P away from panel 1, wherein the top 44 of the downward tongue 22 passes the top 42 of the upward tongue 21. Consequently, the protrusion 54 and recess 56 become dislodged as well, so that both the vertical and horizontal interlocking shown in FIG. 5 are dislodged, and the panels are uncoupled.

Figure 7:
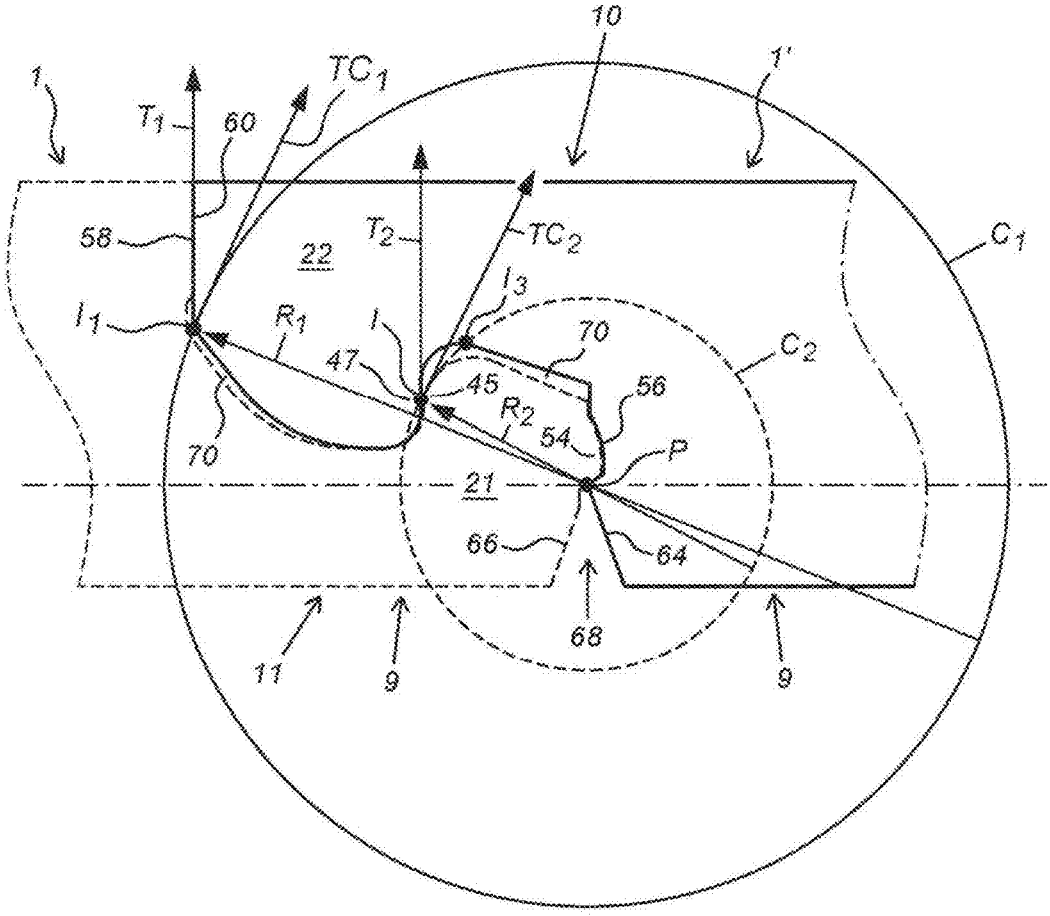
FIG. 7 shows the two profiles of FIG. 5 in a coupled condition in a common plane, wherein the profiles are analysed by means arrows, lines, and circles.

FIG. 7 is identical to FIG. 5, though wherein the profiles are analysed by means arrows, lines, and circles. In the shown cross-section, a first virtual line R1 extending between the pivot point P (or pivot zone) to a—or any—portion of the second upper contact surface 60 defines a first radius R1 of a first virtual angling out circle C1 representative for the movement of the second profile 10 with respect to the first profile 11 during uncoupling of these profiles 10, 11, wherein at the intersection 11 of said first virtual circle C1 and the second upper contact surface portion 60 an upwardly directed first tangent T1 to said second upper contact surface portion 60 points away from said first virtual circle C1, and (therefore) points away from a first circle tangent TC1 at said intersection 11. This allows a preferably entirely unhindered uncoupling of the contact surfaces 58, 60, since frictional contact between said contact surfaces 58, 60 can be kept to a minimum during uncoupling. What is further shown in FIG. 7 is a second virtual line R2 extending between the pivot point P (or pivot zone) to a—or any—portion of the second interlocking surface area 47 defines a second radius R2 of a second virtual angling out circle C2 representative for the movement of the second profile 10 with respect to the first profile 11 during uncoupling, wherein the portion of the second interlocking surface area 47 is chosen such that the second virtual circle C2 intersects the upward tongue 21, and wherein at the intersection 12 of said second virtual circle C2 and the second interlocking surface area 47 an upwardly directed second tangent T2 to said second interlocking surface area 47 points away from said second virtual circle C2. It is further shown that the portion of the second interlocking surface area 47 is chosen such that the second virtual circle C2 intersects an outer surface of the upward tongue at at least two distant points I2, I3. During uncoupling the second interlocking surface area 47 will have to be forced along the first interlocking surface area 45, which is typically realized by (temporary) deforming the second interlocking surface area 47 and/or the first interlocking surface area 45 during uncoupling. This prevents an easy, undesired uncoupling of the panels, which is in favour of the desired (horizontal and vertical) locking effect in interconnected condition of the panels.

Figure 8:
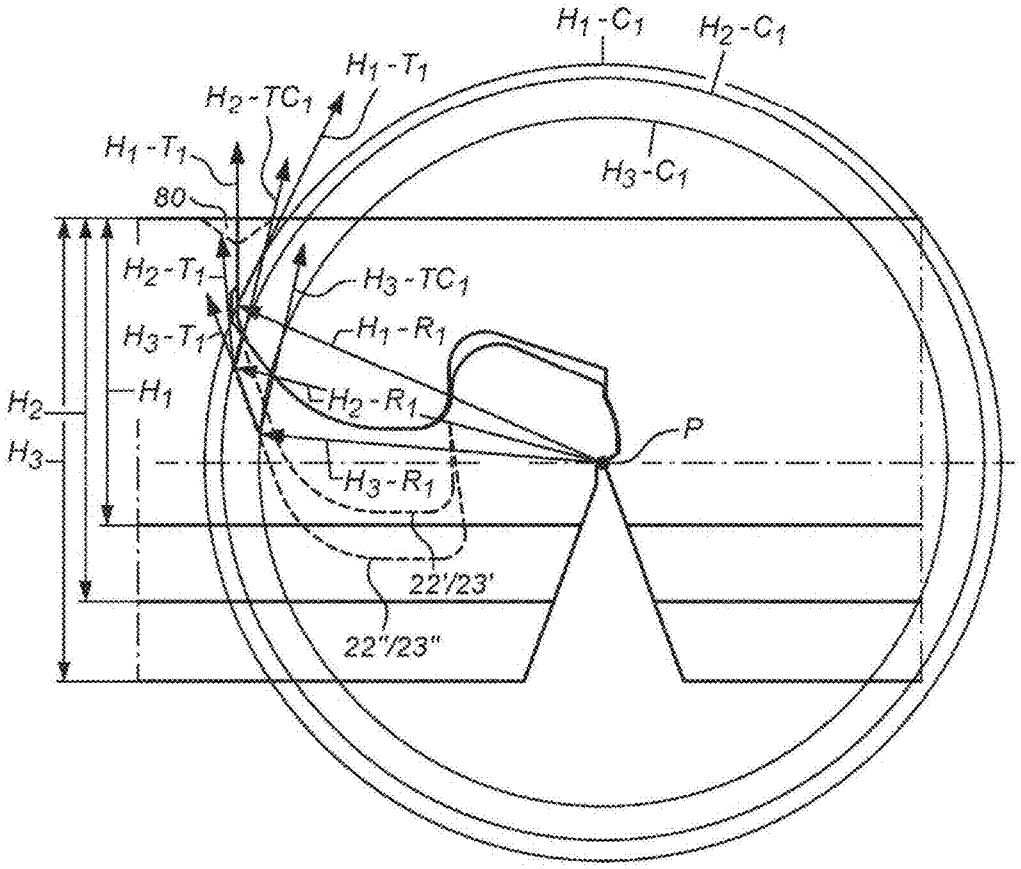
FIG. 8 shows the two profiles of FIG. 5 with various thicknesses and wherein the profiles are analysed by means arrows, lines, and circles.

FIG. 8 is quite similar to FIG. 7 and FIG. 5, panels with various panel thicknesses H1, H2, H3 are shown, and wherein for each panel thickness H1, H2, H3, the corresponding arrows, lines, and circles are shown which are also depicted in FIG. 7. The same reference signs and symbols which are used in FIG. 7 are also used in FIG. 8, but wherein are prefix "H1-", "H2-", and "H3-" is applied for the panels with thickness H1, H2, H3, respectively.

In the panels with thickness H2, H3, the height and the shape of the upward groove 23 and the downward tongue 22 have been modified with respect to the original panel with thickness H1, which have been indicated by reference signs 22', 23' (for panel thickness H2) and 22", 23" (for panel thickness H3). The uncoupling mechanism for each panels thickness H1, H2, H3 is, however, similar.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application. As shown with dashed lines, a top section of the upper contact surfaces 58, 60 of the panel (irrespective of the panel thickness) may be provided with a cut-out portion to form a bevel 80 (or grout).

Figure 9:
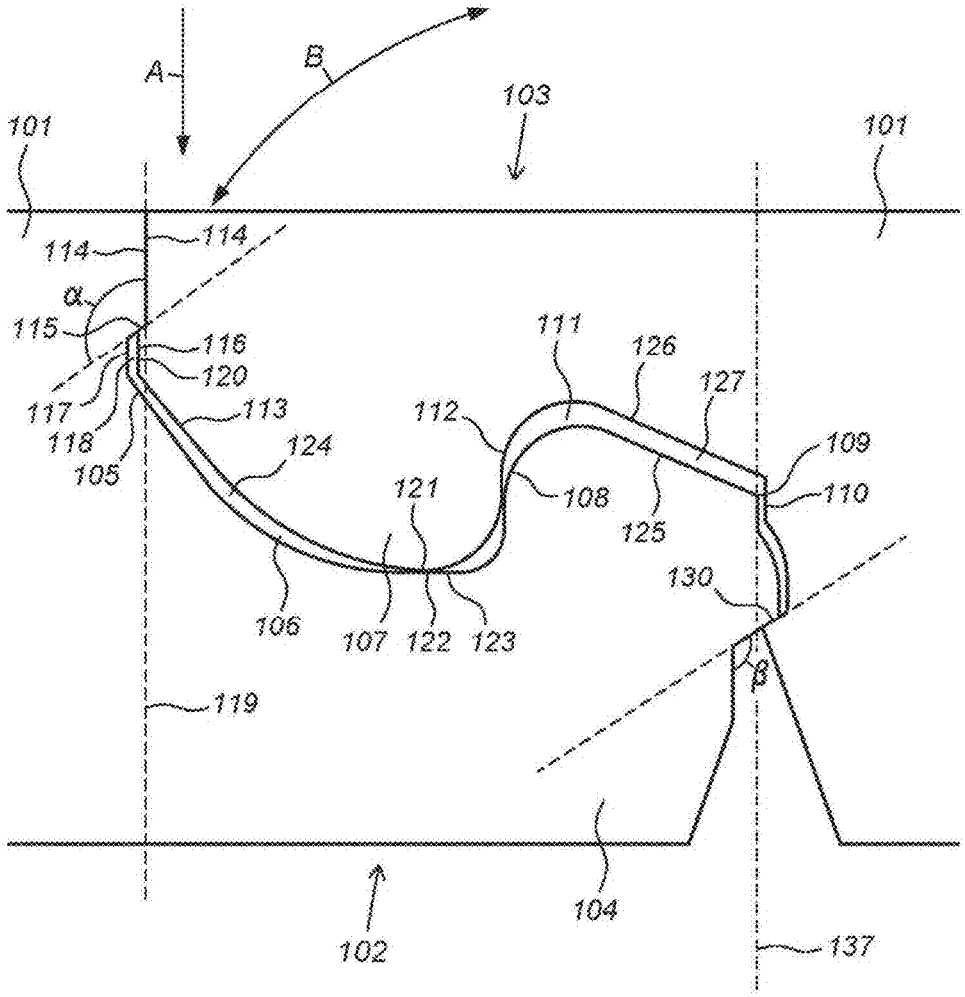
FIG. 9 schematically shows two alternative interconnected panels with first and second coupling parts according to the present invention.

FIG. 9 shows a floor panel 101, comprising a first coupling part 102 and a second coupling part 103 in coupled condition. The first coupling part 102 comprises an upward tongue 104, an upward flank 105 lying at a distance from the upward tongue 104 and an upward groove 106 formed in between the upward tongue 104 and the upward flank 105, wherein the upward groove 106 adapted the downward tongue 107 of a second coupling part 103 of another panel 101. The side of the upward tongue 104 facing towards the upward flank is the inside 108 of the upward tongue 104 and the side of the upward tongue 104 facing away from the upward flank 105 is the outside 109 of the upward tongue 104. The second coupling part 103 comprises a downward tongue 107, a downward flank 110 lying at a distance from the downward tongue 107, and a downward groove 111 formed in between the downward tongue 107 and the downward flank 110. The side of the downward tongue 107 facing towards the downward flank 110 is the inside 112 of the downward tongue 107 and the side of the downward tongue 107 facing away from the downward flank 110 is the outside 113 of the downward tongue 107. The outside 113 of the downward tongue 107 and the upward flank 105 both comprise an upper contact surface 114 at the top of the panel 101, which upper contact surfaces 114 are in contact extend vertically. Adjoining the upper contact surfaces 114 both the downward tongue 107 and the upward flank 105 comprise an inclined contact surface 115, which inclined contact surfaces 115 are in contact, wherein the upper contact surfaces 114 on the one hand, and the inclined contact surfaces 115 of the upward flank 105 and/or the outside 113 of the downward tongue 107 on the other hand preferably mutually enclose an angle $\alpha$ of approximately 125 degrees. The upper contact surface 114 and the inclined contact surface 115 of the upward flank 105 mutually enclose a first angle of about 125 degrees, and the upper contact surface 114 and the inclined contact surface 115 of the downward tongue 107 mutually enclose a second angle of about 125 degrees.

Adjoining the inclined contact surface 115 the downward tongue 107 comprises an outer surface 116, and adjoining the inclined contact surface 115 the upward flank 105 comprises an inner surface 117, wherein the outer 116 and inner 117 surface are parallel and vertical. Between the outer surface 116 and the inner surface 117 a space 118 is present. The upper contact surfaces 114 define an inner vertical plane 119, wherein the inclined contact surface 115 of the downward tongue 107 extends beyond the inner vertical plane 119 the inclined contact surface 115 of the upward flank 105 lies inward compared to the inner vertical plane 119. A portion 120 of the downward tongue 107 extends beyond the inner vertical plane 119, wherein said portion 120 is substantially trapezium-shaped or wedge-shaped. The inclined contact surfaces 115 are both arranged completely outside and adjoining the inner vertical plane 119. The portion 120 is elongated with a larger vertical portion compared to the horizontal portion. The bottom 121 of the downward tongue 107 contacts the upper side 122 of the upward groove 106 at a groove contact surface 123, wherein a gap 124 is present between the first 102 and second 103 coupling parts, extending from the inclined contact surfaces 115 to the groove contact surface 123. Additionally the upper surface 125 of the upward tongue 104 and the upper surface 126 of the downward groove 111, are distanced from each other such that a gap 127 is present between the two surfaces 125, 126. The outside 109 of the upward tongue 104 comprises a first locking element 128, in the form of an outward bulge and the downward flank 110 is provided with a second locking element 129, in the form of a recess, wherein the first 128 and at least a part of second 129 locking element are in contact, and form a locking element surface 130. The panels 101 can be coupled by means of a drop-down motion (vertical movement) visualized by arrow A and may also be coupled by means of a angling in movement (rotary movement) visualized by arrow B and can be uncoupled by means of an angling out movement, as (also) visualized by arrow B.

Figure 10:
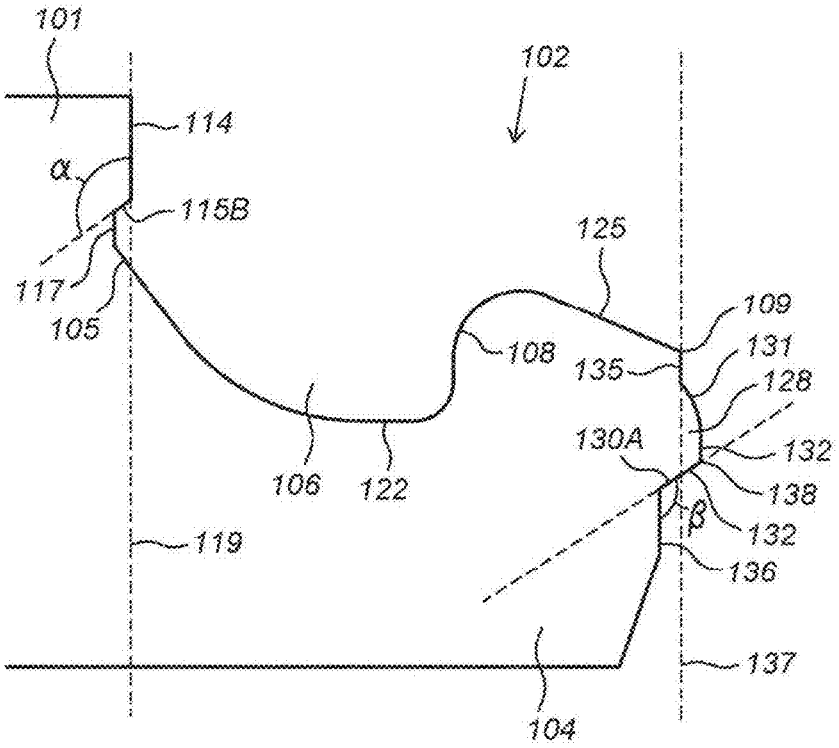
FIG. 10 schematically shows a first coupling part of a panel according to the present invention and FIG. 9.
Figure 11:
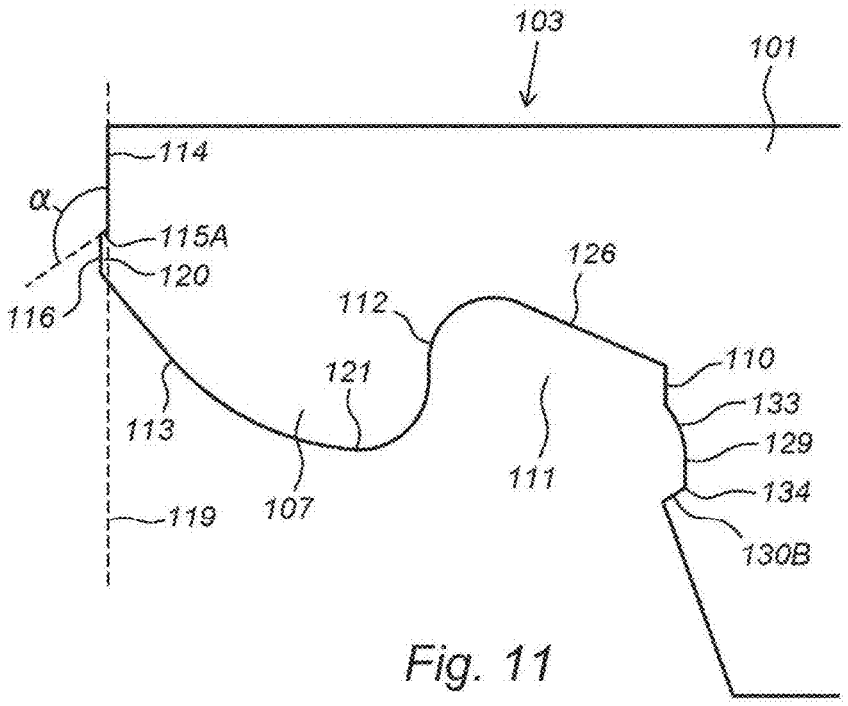
FIG. 11 schematically shows a second coupling part of a panel according to the present invention and FIG. 9.

FIGS. 10 and 11 show the first and second coupling parts individually. The outside of the outward bulge 128 comprises an upper portion 131 and an adjoining lower portion 132, wherein the lower portion 132 comprises an inclined locking surface 130*a* and the upper portion 131 comprises a curved, guiding surface 132. The recess 129 comprises an upper portion 133 and an adjoining lower portion 134, wherein the lower portion comprises an inclined locking surface 130B. The upper portion 131, 133 extends over a larger vertical section compared to the lower portion 132, 134. The parts of the first 128 and second 129 locking element that are in contact are the inclined locking surfaces 130, 130A, 130B of the locking elements 128, 129 and the upper portions 131, 133 of the first 128 and second 129 locking elements are spaced apart at least partially. The outside 109 of the upward tongue 107 comprises an upper outside portion 135, and a lower outside portion 136, wherein the first locking element 128 is arranged between the upper 135 and lower outside portion 136. The lower outside portion 136 is arranged closer to the inside 108 of the upward tongue 104 compared to the upper outside portion 135. The upper outside portion 135 is substantially vertical and defines an outer vertical plane 137, wherein the first locking element 128 protrudes from the outer vertical plane 137. The lower outside portion 136 is substantially vertical and the inclined locking surface 130A or the lower portion 132 and the lower outside portion 136 enclose an angle $\beta$ between 100 and 175 degrees. The angle $\alpha$ enclosed by the upper contact surfaces and the inclined contact surfaces and the angle $\beta$ enclosed by the lower outside portion 136 and the inclined locking surface 130A or the lower portion 132 is about the same. An outermost portion 138 of the first locking element 128 and the locking surface 130*a* are arranged at a horizontal level which is lower compared to the upward groove 106. The same applies to the inclined counterlocking surface 130B of the recess 129.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re) combined in order to arrive at a specific application.

By "complementary" coupling profiles or elements thereof is meant that these coupling profiles or elements can cooperate with each other. However, to this end, the complementary coupling profiles or elements do not necessarily have to have complementary shapes.

The verb "comprise" and conjugations thereof used in this patent publication are understood to mean not only "comprise", but are also understood to mean the phrases "contain", "substantially consist of", "formed by" and conjugations thereof.

What is claimed:

1. A panel suitable as a floor, ceiling, or wall panel, which panel is of a planar design having an upper side, a bottom side, and side edges that comprise a first side edge provided with a first profile and a second side edge provided with a second profile, wherein the first profile and the second profile are mutually interacting profiles that can be coupled to each other, so that a first panel can be coupled in one common plane to a second, identical panel by the mutually interacting profiles, wherein the first profile and the second profile in a coupled condition establish an interlocking with each other both in a horizontal direction and in a vertical direction, and wherein the first profile and the second profile are configured to allow for:

a coupling of the mutually interacting profiles of the first panel and the second panel by a vertical insertion of the mutually interacting profile of the second panel into the mutually interacting profile of the first panel, and an uncoupling of said mutually interacting profiles of the first panel and the second panel by a downward angling movement between the first panel and the second panel out of the common plane;

wherein the first profile is provided along the first side edge of the panel, and comprises an upward tongue which is connected to the first side edge by a lower bridge part extending parallel to a plane of the panel at the bottom side of the panel, and wherein the lower bridge part delimits an upward groove which is enclosed between the upward tongue and the first side edge;

wherein the second profile is provided along the second side edge of the panel, comprises a downward tongue which is connected to the second side edge by an upper bridge part extending parallel to a plane of the panel at a top side of the panel, and wherein the upper bridge part delimits a downward groove which is enclosed between the downward tongue and the second side edge;

wherein the upward groove and the downward groove are configured to receive respectively the downward tongue and the upward tongue when the respective mutually interacting profiles of two identical panels are coupled to each other;

wherein a frontal side of the upward tongue of the first profile is provided with at least one locking element and a horizontally opposed frontal side of the second profile is provided with a counterlocking element, wherein the locking element and the counterlocking element are substantially complementary, such that in a coupled condition of two panels, the locking element of the first profile and the counterlocking element of the second profile mutually interlock, and wherein the locking element and the counterlocking element define at least one pivot point or at least one pivot zone around which, in coupled condition of the two panels, the two panels can be mutually angled downwardly during uncoupling of said first profile and the second profile; and wherein the locking element comprises at least one locking surface, and wherein the counterlocking element comprises at least one counterlocking surface, such that in the coupled condition of two panels, the locking surface and the counterlocking surface are configured to co-act with each other to realize a locking effect in at least a vertical direction, wherein the pivot point or at least one pivot zone are located at a level which is below a deepest point of the downward tongue.

2. The panel according to claim 1, wherein the first profile and the second profile are complementary profiles.

3. The panel according to claim 1, wherein the locking surface and the counterlocking surface are located at a level which is below a deepest point of the upward groove.

4. The panel according to claim 1, wherein a surface of the upward tongue that borders on the downward groove comprises an interlocking surface area which is angled upwards and towards the downward groove, at an angle of 1 to 20 degrees with respect to an upward vertical vector of the panel, when measured in a vertical plane perpendicular to the first side edge, and wherein a surface of the downward tongue that borders on the upward groove, comprises an interlocking surface area which is angled upwards and away from the upward groove, at an angle of 1 to 20 degrees with respect to an upward vertical vector of the panel, when measured in a vertical plane perpendicular to the second side edge, wherein, when the mutually interacting profiles of two identical panels are coupled to each other, the interlocking surface areas of the upward tongue and the downward tongue interact with each other such that a vertical interlocking is achieved.

5. The panel according to claim 4, wherein the interlocking surface areas of the downward tongue and the upward tongue are configured to be facing each other, in abutting contact, when the first and second panels are in a coupled condition.

6. The panel according to claim 4, wherein the interlocking surface areas are part of a curved surface of the downward tongue and the upward tongue, when viewed in a cross-sectional vertical plane perpendicular to the respective side edge.

7. The panel according to claim 6, wherein the curved surface of the downward tongue and the upward tongue has a convex form between the interlocking surface area and a top of the respective tongue, when viewed in a cross-sectional vertical plane perpendicular to the respective side edge.

8. The panel according to claim 6, wherein the curved surface of the downward tongue and the upward tongue has a concave form between the interlocking surface area and a bottom of the corresponding downward groove and upward groove, when viewed in a cross-sectional vertical plane perpendicular to the respective side edge.

9. The panel according to claim 4, wherein at least one of the interlocking surface areas of the downward tongue and the upward tongue is provided with a malleable coating.

10. The panel according to claim 3, wherein an upper part of the first side edge of the first panel and an upper part of the downward tongue of the second side edge of the second panel comprise respective upper contact surfaces which are configured to be in abutting contact when the first and second panels are in coupled condition, which upper contact surfaces are substantially vertically oriented.

11. The panel according to claim 10, wherein at least one of the upper contact surfaces of the first panel and the second panel is provided with a malleable coating.

12. The panel according to claim 1, wherein an upper part of the first side edge comprises a first upper contact surface, and wherein an upper part of an outer side of the downward tongue of the second profile defines a second upper contact surface, which first and second contact surfaces are configured to be in abutting contact when a first and a second panel are in coupled condition such that a substantially watertight seam is created between the first and the second panels.

13. The panel according to claim 1, wherein, in a cross-section of the panel, a first virtual line extending between the pivot point or pivot zone to a portion of the second upper contact surface defines a first radius of a first virtual angling out circle representative for the movement of the second profile with respect to the first profile during uncoupling, wherein at an intersection of said first virtual circle and the second upper contact surface portion an upwardly directed first tangent to said second upper contact surface portion points away from said first virtual circle.

14. The panel according to claim 1, wherein, in a cross-section of the panel, a second virtual line extending between the pivot point or pivot zone to a portion of a second interlocking surface area defines a second radius of a second virtual angling out circle representative for the movement of the second profile with respect to the first profile during uncoupling, wherein a portion of the second interlocking surface area is chosen such that the second virtual circle intersects the upward tongue, and wherein at an intersection of said second virtual circle and the second interlocking surface area an upwardly directed second tangent to said second interlocking surface area points away from said second virtual circle.

15. The panel according to claim 14, wherein the portion of the second interlocking surface area is chosen such that the second virtual circle intersects an outer surface of the upward tongue at at least two distant points.

16. The panel according to claim 1, comprising a third side edge which is provided with an identical first profile as provided on the first side edge, and a fourth side edge which is provided with an identical second profile as provided on the second side edge.

17. The panel according to claim 1, wherein the panel comprises at least one third profile and at least one fourth profile arranged on another pair of opposite sides of the panel, wherein the third profile of said panel and the fourth profile of another panel are arranged to be coupled by means of an angling down motion.

18. A covering for a floor, ceiling, or wall, which is constituted by a multitude of coupled panels according to claim 1.

* * * * *